US005593751A

United States Patent [19]

Yu et al.

[11] Patent Number: 5,593,751

[45] Date of Patent: Jan. 14, 1997

[54] NYLON FIBER BLENDS FOR SAXONY CARPETS

[75] Inventors: Jing-peir Yu; Mukesh Bheda; Raymond S. Knorr, all of Pensacola, Fla.

[73] Assignee: Monsanto Company, St. Louis, Mo.

[21] Appl. No.: 458,152

[22] Filed: Jun. 2, 1995

[51] Int. Cl.[6] ..... B32B 3/02; D05C 17/00; D02G 3/02; D02G 3/36

[52] U.S. Cl. ..... 428/97; 428/92; 57/244; 57/245

[58] Field of Search ..... 428/92, 97; 57/244, 57/245

[56] References Cited

U.S. PATENT DOCUMENTS

| | | | |
|---|---|---|---|
| 3,583,147 | 6/1971 | Brizzolara, Jr. et al. | 57/245 |
| 3,939,636 | 2/1976 | Nakayama et al. | 57/245 |
| 3,994,121 | 11/1976 | Adams | 57/140 |
| 3,994,122 | 11/1976 | Shah | 57/140 R |
| 4,019,311 | 4/1977 | Schippers | 57/245 |
| 4,100,725 | 7/1978 | Magel | 57/140 |
| 4,323,612 | 4/1982 | Van Issum | 428/97 |
| 4,355,592 | 10/1982 | Tajiri et al. | 112/410 |
| 4,452,160 | 6/1984 | Tajiri et al. | 112/410 |
| 4,472,481 | 9/1984 | Snooks, Jr. et al. | 428/362 |
| 4,648,240 | 3/1987 | Hallsworth et al. | 57/288 |
| 4,835,956 | 6/1989 | Sasaki et al. | 57/245 |
| 4,845,934 | 7/1989 | Bauer | 57/747 |
| 4,882,222 | 11/1989 | Talley, Jr. et al. | 428/362 |
| 4,983,448 | 1/1991 | Karageorgiou | 428/224 |
| 5,102,713 | 4/1992 | Corbin et al. | 428/92 |
| 5,209,974 | 5/1993 | Martin et al. | 57/245 |
| 5,344,708 | 9/1994 | Windley | 428/364 |
| 5,364,701 | 11/1994 | Boles et al. | 428/373 |
| 5,399,306 | 3/1995 | Follows et al. | 264/103 |
| 5,478,624 | 12/1995 | Lofquist | 428/97 |

FOREIGN PATENT DOCUMENTS

| | | | |
|---|---|---|---|
| 50-154549 | 12/1975 | Japan | 57/245 |
| 53-147837 | 12/1978 | Japan | 57/245 |
| 56-107042 | 8/1981 | Japan | 57/245 |

*Primary Examiner*—Terrel Morris

[57] ABSTRACT

A yarn formed from a blend of nylon fibers is disclosed. The yarn exhibits improved bulk characteristics and, when utilized as pile yarn in carpet constructions, provides a carpet with improved appearance retention properties with respect to tuft endpoint definition and lack of matting.

20 Claims, No Drawings

NYLON FIBER BLENDS FOR SAXONY CARPETS

BACKGROUND OF THE INVENTION

1. Field of the Invention

The present invention is directed to a saxony carpet exhibiting improved bulk and appearance retention. More specifically, the present invention is directed to a saxony carpet including pile yarn formed from a blend of nylon fibers.

2. Description of the Prior Art

It is known in the art of carpet manufacture that various fiber blends can be useful for carpet pile yarns, including pile yarns for saxony carpet. For example, U.S. Pat. No. 4,839,211, assigned to the assignee of the present invention, discloses a saxony carpet with pile yarn formed from a blend of carpet fibers and high shrinkage acrylic fibers. Similarly, U.S. Pat. No. 5,102,713 discloses a saxony carpet having pile formed from a blend of low shrinkage polyester fibers and high shrinkage polyester fibers. Also, U.S. Pat. No. 5,364,701 discloses a mixed filament textile yarn of polyester filaments and nylon filaments.

Each of these blends is asserted to impart certain specified desirable characteristics to the subject carpet including, for example, improved appearance retention, bulk, firmness and luster. Unfortunately, the very existence of diverse types of fibers in fiber blends gives rise to drawbacks in the blends and their end-use products. For example, processing of the blends into yarn may require specific controls or operating conditions such as those disclosed at column 4, line 35 of the '211 patent discussed above. Further, blends which include fibers of different polymer types may present difficult dyeing and processing challenges due to the natures of the different polymers.

A need therefore exists for a fiber blend for carpet pile yarn which provides desirable performance characteristics but which is easily processable into a uniform final product.

SUMMARY OF THE INVENTION

The present invention satisfies this need and achieves other benefits as set forth in detail below by providing a fiber blend useful for heatset, saxony carpet pile yarn. The blend includes from 94% to 55% by weight based on the total weight of the blend of a first nylon fiber and from 6% to 45% by weight based on total weight of the blend of a second nylon fiber. The first nylon fiber is formed from a first nylon which includes at least 95% by weight, based on the total weight of the first nylon, nylon 6,6 recurring units of the formula $$-NH(CH_2)_6NHC(=O)(CH_2)_4C(=O)- \quad \text{(I)}$$

while the second nylon fiber is formed from a second nylon including at most 85% by weight, based on the total weight of the second nylon, nylon 6,6 recurring units of the formula $$-NH(CH_2)_6NHC(=O)(CH_2)_4C(=O)- \quad \text{(I)}$$

and at least 15% by weight, based on the total weight of the second nylon, of one or more recurring units selected from the group consisting of $$\text{nylon 6, } -NH(CH_2)_5C(=O)-; \quad \text{(II)}$$

$$\text{nylon 6, 9, } -NH(CH_2)_6NHC(=O)(CH_2)_7C(=O)-; \quad \text{(III)}$$

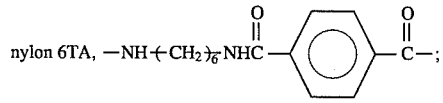

(IV)

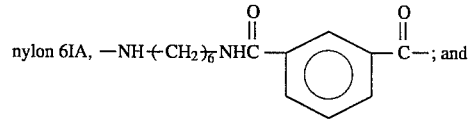

(V)

$$\text{nylon 6, 10, } -NH(CH_2)_6NHC(=O)(CH_2)_8C(=O)-. \quad \text{(VI)}$$

Heatset pile yarn formed from the blend of the present invention exhibits a bulk value of at least 20% as tested in accordance with the procedure below. Further, saxony carpet having as its pile a pile yarn formed from the blend of the present invention exhibits improved appearance retention over carpets formed from conventional carpet yarns.

DETAILED DESCRIPTION OF THE PREFERRED EMBODIMENTS

The term "fiber", as utilized herein, is defined to include individual staple fibers and continuous filaments. The term "nylon", as utilized herein, is defined to include nylon homopolymers, copolymers, terpolymers and the like, as well as blends thereof. The term "saxony carpet", as utilized herein, is defined to include cut-pile carpets having twisted, evenly sheared pile yarns. All percentages set forth herein are by weight unless otherwise indicated.

The blend of the present invention includes two types of nylon fibers formed from two distinct types of nylon polymers. The blend includes from 94% to 55% based on the total weight of the blend of a first nylon fiber and from 6% to 45% based on the total weight of the blend of a second nylon fiber. More preferably, the blend includes from 92% to 75% based on the total weight of the blend of a first nylon fiber and from 8% to 25% based on the total weight of the blend of a second nylon fiber. Most preferably, the blend includes from 89% to 80% based on the total weight of the blend of a first nylon fiber and from 11% to 20% based on the total weight of the blend of a second nylon fiber.

The first nylon fiber is formed from a first nylon which includes at least 95% by weight, based on the total weight of the first nylon, nylon 6,6 recurring units of the formula $$-NH(CH_2)_6NHC(=O)(CH_2)_4C(=O)-. \quad \text{(I)}$$

Nylons suitable for the first nylon include nylon 6,6, copolymers and terpolymers thereof. Preferred first nylons include a nylon copolymer of 97% nylon 6,6, 3% nylon 6, and nylon 6,6 homopolymer.

The second nylon fiber is formed from a second nylon including at most 85% by weight, based on the total weight of the second nylon, nylon 6,6 recurring units of the formula $$-NH(CH_2)_6NHC(CH_2)_4C- \quad (I)$$

and at least 15% by weight, based on the total weight of the second nylon, of one or more recurring units selected from the group consisting of $$\text{nylon 6, } -NH(CH_2)_5C-; \quad (II)$$

$$\text{nylon 6, 9, } -NH(CH_2)_6NHC(CH_2)_7C-; \quad (III)$$

nylon 6TA, 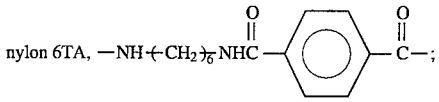 (IV)

nylon 6IA, 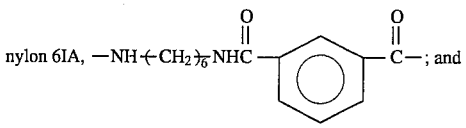 (V)

$$\text{nylon 6, 10, } -NH(CH_2)_6NHC(CH_2)_8C-. \quad (VI)$$

Nylons which are suitable as the second nylon of the present invention include copolymers of nylon 6,6 and nylon 6; copolymers of nylon 6,6 and nylon 6,9; copolymers of nylon 6,6 and nylon 6,10; copolymers of nylon 6,6 and nylon 6IA; terpolymers of nylon 6,6, nylon 6,9, and nylon 6TA; terpolymers of nylon 6,6, nylon 6,10, and nylon 6TA; and terpolymers of nylon 6,6, nylon 6TA, and nylon 6IA. In a first preferred embodiment, the second nylon includes a nylon copolymer of 79% nylon 6,6 and 21% nylon 6. In a second preferred embodiment, the second nylon includes a nylon terpolymer of 40% nylon 6,6, 30% nylon 6,9, and 30% nylon 6TA. In a third preferred embodiment, the second nylon includes a nylon terpolymer of 75% nylon 6,6, 20% nylon 6, and 5% nylon 6TA.

In a first particularly preferred embodiment, the first nylon includes a copolymer of 97% nylon 6,6 and 3% nylon 6 and the second nylon includes a terpolymer of 75% nylon 6,6, 20% nylon 6, and 5% nylon 6TA. In a second particularly preferred embodiment, the first nylon includes nylon 6,6 homopolymer and the second nylon includes a terpolymer of 40% nylon 6,6, 30% nylon 6,9, and 30% nylon 6TA.

The fibers which make up the blends of the present invention may exhibit physical characteristics conventional and known in the art. The fibers may have, for example, a round, multilobal or multifoliate crossection, with modification ratios of from 1.0 to 4.0 and deniers from 8 to 25. It is to be further understood that these characteristics may be constant or may vary from fiber to fiber in the blends of the present invention.

The fibers in the blend of the present invention may be produced by spinning methods known and conventional in the art, for example melt spinning and solution spinning. Melt spinning is the preferred production method.

The blends of the present invention are suitable for use in a heatset yarn. The yarn of the present invention therefore includes nylon fibers formed from two distinct types of nylon polymers. The yarn includes from 94% to 55% based on the total weight of the yarn of a first nylon fiber and from 6% to based on the total weight of the yarn of a second nylon fiber. More preferably, the yarn includes from 92% to 75% based on the total weight of the yarn of a first nylon fiber and from 8% to 25% based on the total weight of the yarn of a second nylon fiber. Most preferably, the yarn includes from 89% to 80% based on the total weight of the yarn of a first nylon fiber and from 11% to 20% based on the total weight of the yarn of a second nylon fiber.

The first nylon fiber is formed from a first nylon which includes at least 95% by weight, based on the total weight of the first nylon, nylon 6,6 recurring units of the formula $$-NH(CH_2)_6NHC(CH_2)_4C-. \quad (I)$$

Nylons suitable for the first nylon include nylon 6,6, copolymers and terpolymers thereof. Preferred first nylons include a nylon copolymer of 97% nylon 6,6, 3% nylon 6, and nylon 6,6 homopolymer.

The second nylon fiber is formed from a second nylon including at most 85% by weight, based on the total weight of the second nylon, nylon 6,6 recurring units of the formula $$-NH(CH_2)_6NHC(CH_2)_4C- \quad (I)$$

and at least 15% by weight, based on the total weight of the second nylon, of one or more recurring units selected from the group consisting of $$\text{nylon 6, } -NH(CH_2)_5C-; \quad (II)$$

$$\text{nylon 6, 9, } -NH(CH_2)_6NHC(CH_2)_7C-; \quad (III)$$

nylon 6TA, 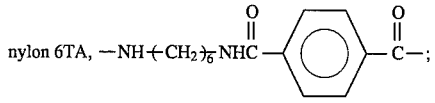 (IV)

nylon 6IA, 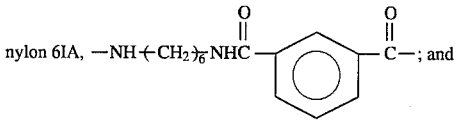 (V)

$$\text{nylon 6, 10, } -NH(CH_2)_6NHC(CH_2)_8C-. \quad (VI)$$

Nylons which are suitable as the second nylon of the present invention include copolymers of nylon 6,6 and nylon 6; copolymers of nylon 6,6 and nylon 6,9; copolymers of nylon 6,6 and nylon 6,10; copolymers of nylon 6,6 and 6IA; terpolymers of nylon 6,6, nylon 6,9, and nylon 6TA; terpolymers of nylon 6,6, nylon 6,10, and nylon 6TA; and terpolymers of nylon 6,6, nylon 6TA, and nylon 6IA. In a first preferred embodiment, the second nylon includes a nylon copolymer of 79% nylon 6,6 and 21% nylon 6. In a second preferred embodiment, the second nylon includes a nylon terpolymer of 40% nylon 6,6, 30% nylon 6,9, and 30% nylon 6TA. In third preferred embodiment, the second nylon includes a nylon terpolymer of 75% nylon 6,6, 20% nylon 6, and 5% nylon 6TA.

In a first particularly preferred embodiment, the first nylon includes a copolymer of 97% nylon 6,6 and 3% nylon 6 and the second nylon includes a terpolymer of 75% nylon 6,6, 20% nylon 6, and 5% nylon 6TA. In a second particularly preferred embodiment, the first nylon includes nylon6,6 homopolymer and the second nylon includes a terpolymer of 40% nylon 6,6, 30% nylon 6,9, and 30% nylon 6TA.

The yarn of the present invention is a heatset yarn, defined herein to include plytwisted yarns to which a heat treatment has been applied to set the twist therein. The yarn includes any degree of twist known and conventional in the art, preferably from 2.0 to 8.0 twists per inch (0.79 to 3.15 twists per centimeter). The denier of the yarn may be any denier known and conventional in the art, preferably from 1600 to 6000.

The yarn is preferably produced by providing the fiber blend of the present invention, combining the fibers in the blend to form a singles yarn, combining two or more singles yarns to form a plytwisted yarn and heating the yarn to set the twist therein. Preferably, the heating step includes subjecting the yarn to a temperature of at least 126° C. in a steam atmosphere.

The heatset yarns of the present invention unexpectedly exhibit and are characterized by a high level of bulk development which is quantified as "Bulk Value" in the test set forth below. More specifically, the yarns of the present invention are characterized by a Bulk Value of at least 20%, preferably at least 25% and most preferably at least 30%.

TEST FOR BULK VALUE DETERMINATION

A 25 yard (22.86 meter) sample of the BCF yarn is produced or procured. If the yarn to be tested is made from bulked continuous filament (BCF), the sample produced is a plytwisted yarn having 4.25 twists per inch (TPI) (1.67 twists per centimeter). If the yarn to be tested is made from staple, the sample is produced according to the following specifications:

Singles cotton count=3.5

Singles twist in "Z" direction=5.4 TPI (2.13 twists per cm)

Plytwist in "S" direction=4.29 TPI (1.69 twists per cm)

The sample is then formed into a skein by winding on a denier reel 1.125 meters in circumference with a yarn tension of 0.033 gm/denier. The number of reel revolutions of the skein is calculated according to the following formula to the closest integer number:

No. of Revolutions=27,222/Denier

The initial length (L0)of the skein is one-half the circumference of the denier reel or 56.25 cm.

The skein is then hung loosely on a stainless steel rod and inserted into a preheated steam pot. Saturated steam is introduced into the pot in an amount and rate sufficient to raise the temperature in the pot to 138° C. Four minutes from the beginning of steam introduction, the steam was exhausted from the pot via a vent valve. The skein (still hung on the rod) is then removed from the pot and allowed to cool in ambient air for five minutes. A 50-gram weight is then hung on the skein and the length of the skein ($L_1$) is measured.

The Bulk Value (%) is then calculated as follows:

$$B=[(L_0-L_1)/L_0]\times 100\%$$

The heatset yarn of the present invention is particularly useful as pile yarn in saxony or textured carpet. Saxony carpet is characterized by substantially straight tufts while textured carpet is characterized by tufts having random bends therein. The carpet of the present invention includes individual lengths (herein referred to as tufts) of the heatset pile yarn of the present invention extending from the top side of a primary backing material and preferably further includes a secondary backing material adhered to the underside of the primary backing with an adhesive layer. The carpet of the present invention is produced by tufting the yarn of the present invention into a primary backing to form loops; cutting the uppermost portion or tip of the loops to form individual short lengths of yarn (referred to herein as tufts); and, preferably, adhering a secondary backing to the primary backing.

It has been unexpectedly discovered that the carpet of the present invention is characterized by improved appearance retention characteristics as quantified by the test set forth below.

TEST FOR CARPET APPEARANCE RETENTION

Carpet test samples and control samples are produced according to the following specifications:

Gauge=5/32 inch (0.0615 cm)

Pile Weight=28 oz/yd$^2$ (950 g/m$^2$)

Pile Height=5/8 in (1.59 cm)

If the carpet pile yarn is made from bulked continuous filament (BCF), the yarn is produced according to the following specifications:

| | |
|---|---|
| Twist: | 4.0 TPI (1.57 twists per cm) for saxony carpets<br>4.25 TPI (1.67 twists per cm) for textured carpets |

If the carpet pile yarn is made from staple, the yarn is produced according to the following specifications:

Singles cotton count=3.5

Single twist in "Z" direction=5.14 TPI (2.02 twists per cm)

Plytwist in "S" direction=4.29 TPI (1.69 twists per cm) for saxony carpet

Plytwist in "S" direction=4.88 TPI (1.92 twists per cm) for textured carpet

The carpet samples are then subjected to a walk test of 20,000 "traffics" wherein a "traffic" is the occurrence of a person walking across the pile surface. The tested samples, including the control(s), are then studied by a skilled carpet grader and each assigned a grade of 1 to 7, with 1 being best and 7 being worst with respect to appearance retention as measured by tuft endpoint definition and lack of matting of the pile.

The following examples, while not intended to limit the spirit and scope of the present invention, are provided to describe in greater detail the present invention and its benefits.

EXAMPLE 1

In this Example, blends of the present invention were formed into plytwisted yarns of the present invention, meeting the specifications set forth in the above Bulk Value Determination Test procedures. The bulk value of these yarns was then measured according to the procedure set forth above. More specifically, the blends listed as items 1 through 3 in Table 1 were formed along with control items 4 and 5 of a singular fiber type and item 6 in which the second nylon polymer has a non-6,6 comonomer content of less than 15%.

TABLE 1

| ITEM | FIRST NYLON FIBER POLYMER | FIRST NYLON FIBER % OF BLEND | SECOND NYLON FIBER POLYMER | SECOND NYLON FIBER % OF BLEND |
|---|---|---|---|---|
| 1 | Nylon 6,6 Homo-polymer | 89.3 | Copolymer of: 79% Nylon 6,6 21% Nylon 6 | 10.7 |
| 2 | Nylon 6,6 Homo-polymer | 86.3 | Copolymer of: 79% Nylon 6,6 21% Nylon 6 | 13.7 |
| 3 | Nylon 6,6 Homo-polymer | 86.4 | Terpolymer of: 40% Nylon 6,6 30% Nylon 6,9 30% Nylon 6TA | 13.6 |
| 4 (Control) | Nylon 6,6 Homo-polymer | 100 | — | — |
| 5 (Control) | Nylon 6 Homo-polymer | 100 | — | — |
| 6 | Nylon 6,6 Homo-polymer | 89.3 | Copolymer of: 87% Nylon 6,6 13% Nylon 6 | 10.7 |

The blends and corresponding yarns were formed by combining filament supply yarns of the two fiber types, and texturing via a conventional jet-texturing process to yield the bulked continuous filament (BCF) yarns. Two individual ends of these BCF yarns were twisted to form plied yarns with 4.25 twists per inch (1.67 twists per centimeter). The plied yarns were then analyzed and bulk values therefor were calculated according to the procedure set forth above. The resulting yarns, their characteristics, and their bulk values are set forth in Table 2 with item numbers corresponding to those in Table 1.

TABLE 2

| ITEM NO. | DENIER | BULK VALUE, % |
|---|---|---|
| 1 | 2,910 | 26.0 |
| 2 | 2,917 | 32.0 |
| 3 | 2,915 | 36.4 |
| 4 (Control) | 2,795 | 12.9 |
| 5 (Control) | 2,912 | 14.0 |
| 6 | 2,894 | 17.9 |

As evidenced by the data set forth above, the yarns of the present invention are characterized by bulk values superior to the control yarns.

EXAMPLE 2

Yarn samples were formed in accordance with the procedures set forth in Example 1 except that yarn twist was varied between samples as indicated in the Table below. These yarns were then heatset by a commercial Superba heatset machine with steam at a temperature of 132.2° C. for yarn to be used in saxony carpet and 137.8° C. for yarn to be used in textured carpet for 0.72 minutes. The yarn specifications are listed in Table 3 below.

TABLE 3

| ITEM | FIRST NYLON FIBER POLYMER[1] | FIRST NYLON FIBER % OF BLEND | SECOND NYLON FIBER POLYMER[1] | SECOND NYLON FIBER % OF BLEND | PLYTWIST TWIST PER INCH/ TWIST PER CM |
|---|---|---|---|---|---|
| 1 | A | 85.5 | C | 14.5 | 4.0/1.57 |
| 2 | A | 85.5 | D | 14.5 | 4.0/1.57 |
| 3 | A | 85.8 | E | 14.2 | 4.0/1.57 |
| 4 | A | 85.0 | F | 15.0 | 4.0/1.57 |
| 5 | A | 85.3 | G | 14.7 | 4.0/1.57 |
| 6 | B | 85.7 | C | 14.3 | 4.0/1.57 |
| 7 | B | 85.7 | D | 14.3 | 4.0/1.57 |
| 8 | B | 86.0 | E | 14.0 | 4.0/1.57 |
| 9 | B | 85.2 | F | 14.8 | 4.0/1.57 |
| 10 | B | 85.5 | G | 14.5 | 4.0/1.57 |
| 11 (Control) | A | 100 | — | | 4.0/1.57 |
| 12 (Control) | B | 100 | — | | 4.0/1.57 |
| 13 | B | 85.8 | H | 14.2 | 4.0/1.57 |
| 14 | B | 85.8 | I | 14.2 | 4.0/1.57 |
| 15 | A | 85.8 | H | 14.2 | 4.25/1.67 |
| 16 | A | 85.8 | I | 14.2 | 4.25/1.67 |
| 17 (Control) | B | 100 | — | — | 4.25/1.67 |

[1]A = 97% Nylon 6,6; 3% Nylon 6 Copolymer
B = Nylon 6,6 Homopolymer
C = 80% Nylon 6,6; 15% Nylon 6; 5% Nylon 6TA Terpolymer
D = 50% Nylon 6,6; 40% Nylon 6IA; 10% Nylon 6TA Terpolymer
E = 80% Nylon 6,6; 20% Nylon 6 Copolymer
F = 75% Nylon 6,6; 20% Nylon 6; 5% Nylon 6TA Terpolymer
G = 70% Nylon 6,6; 30% Nylon 6 Copolymer
H = 79% Nylon 6,6; 21% Nylon 6 Copolymer; Rel. Visc. = 48.5
I = 79% Nylon 6,6; 21% Nylon 6 Copolymer; Rel. Visc. = 35.5

The yarns were then tufted into a conventional carpet backing material, the tufted loops were sheared, and a secondary backing was applied with a latex adhesive to form a carpet. All steps were completed so that each carpet met the specifications set forth in the above appearance retention test. The carpets, including controls, were then graded for appearance retention (A.R.) characteristics according to the specifications and procedures set forth above. The tests results are set forth below in Table 4.

TABLE 4

| ITEM NO. | PLYTWIST TWIST PER INCH/ TWIST PER CM | TYPE OF CARPET | A.R. GRADE |
|---|---|---|---|
| 1 | 4.0/1.57 | Saxony | 3.5 |
| 2 | 4.0/1.57 | Saxony | 3.5 |
| 3 | 4.0/1.57 | Saxony | 4.0 |
| 4 | 4.0/1.57 | Saxony | 3.0 |
| 5 | 4.0/1.57 | Saxony | 3.5 |
| 6 | 4.0/1.57 | Saxony | 3.5 |
| 7 | 4.0/1.57 | Saxony | 4.0 |
| 8 | 4.0/1.57 | Saxony | 4.0 |
| 9 | 4.0/1.57 | Saxony | 3.5 |
| 10 | 4.0/1.57 | Saxony | 4.0 |
| 11 (Control) | 4.0/1.57 | Saxony | 4.5 |
| 12 (Control) | 4.0/1.57 | Saxony | 5.5 |
| 13 | 4.0/1.57 | Saxony | 4.5 |
| 14 | 4.0/1.57 | Saxony | 4.0 |
| 15 | 4.25/1.67 | Textured | 4.5 |
| 16 | 4.25/1.67 | Textured | 4.5 |
| 17 (Control) | 4.25/1.67 | Textured | 5.0 |

As clearly demonstrated by the above, carpets of the present invention are characterized by a high degree of appearance retention.

While the present invention is set forth in detail and exemplified above, it is to be understood that various modification maybe made to the present invention without departing from its spirit and scope. For example, the fiber blends may further include other fiber types, such as electrically conductive or antistatic fibers, which are known to be useful in yarns. Also, the yarns of the present invention may further include additives and/or coating materials such as fluorochemicals or stainblockers which enhance the soil and/or stain resistance of the yarns, especially when utilized in carpet applications.

I claim:

1. A saxony carpet comprising a backing material having a top side and an underside and individual lengths of heatset pile yarn extending outwardly from said top side, said pile yarn comprising from 94% to 55% based on the total weight of the yarn of a first nylon fiber and from 6% to 45% based on the total weight of the yarn of a second nylon fiber wherein said first nylon fiber is formed from a first nylon which includes at least 95% by weight, based on the total weight of the first nylon, nylon 6,6 recurring units of the formula $$-NH(CH_2)_6NHC(CH_2)_4\overset{O}{\overset{\|}{C}}-$$

wherein said second nylon fiber is formed from a second nylon including at most 85% by weight, based on the total weight of the second nylon, nylon 6,6 recurring units of the formula $$-NH(CH_2)_6NHC(CH_2)_4\overset{O}{\overset{\|}{C}}-$$

and at least 15% by weight, based on the total weight of the second nylon, of one or more recurring units selected from the group consisting of nylon 6, $$-NH(CH_2)_5\overset{O}{\overset{\|}{C}}-;$$

nylon 6,9, $$-NH(CH_2)_6NHC(CH_2)_7\overset{O}{\overset{\|}{C}}-;$$

nylon 6TA,

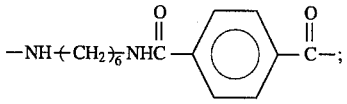

nylon 6IA,

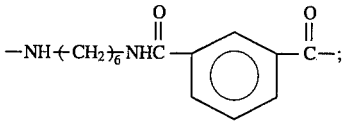

and nylon 6,10, $$-NH(CH_2)_6NHC(CH_2)_8\overset{O}{\overset{\|}{C}}-.$$

2. The carpet of claim 1 wherein said second nylon includes a nylon copolymer of 79% nylon 6,6 and 21% nylon 6.

3. The carpet of claim 1 wherein said second nylon includes a nylon terpolymer of 40% nylon 6,6, 30% nylon 6,9, and 30% nylon 6TA.

4. The carpet of claim 1 wherein said second nylon includes a nylon terpolymer of 75% nylon 6,6, 20% nylon 6, and 5% nylon 6TA.

5. The carpet of claim 3 wherein said first nylon includes a nylon 6,6 homopolymer.

6. The carpet of claim 4 wherein said first nylon includes a copolymer of 97% nylon 6,6 and 3% nylon 6.

7. The carpet of claim 1 wherein said second nylon is a terpolymer of nylon 6,6, nylon 6,9 and nylon 6TA.

8. The carpet of claim 1 wherein said second nylon is a terpolymer of nylon 6,6, nylon 6,10 and nylon 6TA.

9. The carpet of claim 1 wherein said second nylon is a terpolymer of nylon 6,6, nylon 6TA and nylon 6IA.

10. The carpet of claim 1 wherein said second nylon is a terpolymer including nylon 6,6 and nylon 6 units.

11. A heatset yarn useful as pile yarn in saxony carpet, said heatset yarn comprising from 94% to 55% based on the total weight of the yarn of a first nylon fiber and from 6% to 45% based on the total weight of the yarn of a second nylon fiber, wherein said first nylon fiber is formed from a first nylon which includes at least 95% by weight, based on the total weight of the first nylon, nylon 6,6 recurring units of the formula $$-NH(CH_2)_6NHC(CH_2)_4\overset{O}{\overset{\|}{C}}-$$

and wherein said second nylon fiber is formed from a second nylon including at most 85% by weight, based on the total weight of the second nylon, nylon 6,6 recurring units of the formula $$-NH(CH_2)_6NHC(=O)(CH_2)_4C(=O)-$$

and at least 15% by weight, based on the total weight of the second nylon, of one or more recurring units selected from the group consisting of nylon 6, $$-NH(CH_2)_5C(=O)-;$$

nylon 6,9, $$-NH(CH_2)_6NHC(=O)(CH_2)_7C(=O)-;$$

nylon 6TA,

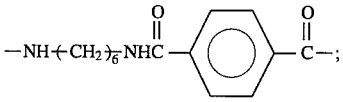

nylon 6IA,

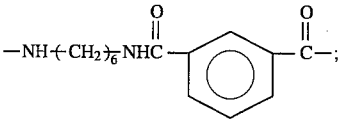

-continued and nylon 6,10, $$-NH(CH_2)_6NHC(=O)(CH_2)_8C(=O)-.$$

12. The yarn of claim 11 wherein said second nylon includes a nylon copolymer of 79% nylon 6,6 and nylon 6.

13. The yarn of claim 11 wherein said second nylon includes a nylon terpolymer of 40% nylon 6,6, 30% nylon 6,9, and 30 % nylon 6TA.

14. The yarn of claim 11 wherein said second nylon includes a nylon terpolymer of 75% nylon 6,6, 20% nylon 6, and 5% nylon 6TA.

15. The yarn of claim 13 wherein said first nylon includes a nylon 6,6 homopolymer.

16. The yarn of claim 14 wherein said first nylon includes a copolymer of 97% nylon 6,6 and 3% nylon 6.

17. The yarn of claim 11 wherein said second nylon is a terpolymer of nylon 6,6, nylon 6,9 and nylon 6TA.

18. The yarn of claim 11 wherein said second nylon is a terpolymer of nylon 6,6, nylon 6,10 and nylon 6TA.

19. The yarn of claim 11 wherein said second nylon is a terpolymer of nylon 6,6, nylon 6TA and nylon 6IA.

20. The yarn of claim 11 wherein said second nylon is a terpolymer including nylon 6,6 and nylon 6 units.

* * * * *